United States Patent [19]

Fujihara et al.

[11] Patent Number: 4,705,209

[45] Date of Patent: Nov. 10, 1987

[54] ERECTABLE CONTAINER

[75] Inventors: Takeo Fujihara, Takatsuki; Akira Yamatani, Minoo; Masanori Yamamoto, Kaizuka; Yuji Kunimoto, Kobe, all of Japan

[73] Assignee: House Food Industrial Company Limited, Higashiosaka, Japan

[21] Appl. No.: 904,353

[22] Filed: Sep. 8, 1986

[30] Foreign Application Priority Data

Sep. 10, 1985 [JP] Japan ..... 60-138626[U]

[51] Int. Cl.[4] ..... B65D 5/24

[52] U.S. Cl. ..... 229/109; 229/8; 229/113; 229/155; 229/169; 229/186

[58] Field of Search ..... 229/8, 43, 155, 186, 229/189, 902, 905, 109, 41 C, 169, 45 R, 113

[56] References Cited

U.S. PATENT DOCUMENTS 3,462,065 8/1969 Asman ..... 229/109
3,536,248 10/1970 Odenhagen et al. ..... 229/169

FOREIGN PATENT DOCUMENTS 2612892 10/1976 Fed. Rep. of Germany .... 229/45 R
85/03687 8/1985 PCT Int'l Appl. ..... 229/41 C
1436205 5/1976 United Kingdom ..... 229/169

*Primary Examiner*—Stephen Marcus
*Assistant Examiner*—Gary E. Elkins
*Attorney, Agent, or Firm*—Oblon, Fisher, Spivak, McClelland, & Maier

[57] ABSTRACT

An erectable container formed by folding a single base board, in which a bottom surface is made in a polygonal form having more than six sides of an even number, first and second side plates are alternately integrally provided extending from each side of the bottom surface provided with a concave fold line, a lid plate is integrally provided at the edge of the first side plate, a tab is integrally provided at the edge of the second side plate, the second side plate being provided with two first convex fold lines extending till upper ends from each vertex at the lower end thereof and the tab being provided with two second convex fold lines extending till upper ends from each end of the first convex fold lines and approaching toward each other with an inclination greater than that of the first convex fold lines, and the boundary line between the second side plate and the tab is made a concave fold at the portion between each end of the first convex fold.

2 Claims, 3 Drawing Figures

ERECTABLE CONTAINER

FIELD OF THE INVENTION

The present invention relates to an erectable container erected by folding a single base board.

DESCRIPTION OF THE PRIOR ART

A container erected by folding a single base board is proposed by Japanese Utility Model Publication No. 57-35580. As illustrated in FIG. 3, the proposed container is constituted in such a manner that each side of a bottom plate 52 of a regular tetragonal or regular octagonal form is integrally provided, alternately, by pentagonal side plates 53 having the top portion 53*a* cut off by a curve 56 and by triangular or tetragonal side plates 54, and a triangular fold portion 55 is integrally provided between the pentagonal side plate 53 and the triangular or tetragonal side 54 thereby forming a single sheet of a regular square form; and when said side plates 53 and 54 are erected, the fold 55 is folded in between the two sides to complete a container.

However, since the proposed container retains its shape simply by folding the fold lines provided between the pentagonal side plates 53, tetragonal side plates 54 and the folds 55, the container is inferior in retentivity of shape. Especially when this container is used for heating foods that solidify with heat, such as steamed bread, cake and bean curd, or for heating, for the purpose of melting, foods that solidify when chilled, such as sweet jelly of beans or jelly, there occurs a problem that the container is easily unfolded because of the weight of the liquid content.

OBJECT OF THE INVENTION

It is, therefore, an object of the present invention to provide an erectable container that is superior in retentivity of shape, especially when the lid is half open.

SUMMARY OF THE INVENTION

According to the present invention, the above and other objects can be accomplished by an erectable container formed by folding a single base board and comprising a bottom surface made in a polygonal form having more than six sides of an even number, first and second side plates alternately integrally extending from each side of the bottom surface via respective concave fold lines therebetween, a lid plate integrally provided on each said first side plate at an upper edge thereof opposite said concave fold line, each lid plate being hook shaped at an upper edge thereof, and a tab integrally provided on each second side plate at an upper edge thereof opposite the concave fold lines. Each second side plate is provided with two inclined first convex fold lines extending from respective lower vertexes thereof to separate points intermediate the upper edge thereof. Each tab is provided with two second convex fold lines extending from respective ones of the intermediate points to an upper edge of the tab. The second convex fold lines approach each other with an inclination greater than that of the first convex fold lines. Each second side plate and tab are connected via a fold line that is concave at the portion between the intermediate points and is convex at the remaining portions.

It should be noted that the terms concave fold line and convex fold line are used simply to mark a fold line at the time the base board is processed and to mean an actual concave fold or convex fold at the time of assemblying the container.

The above and other objects and features of the present invention will become apparent from the following description of a preferred embodiment with reference to the accompanying drawings.

DESCRIPTION OF THE PREFERRED EMBODIMENT

Figure 1:
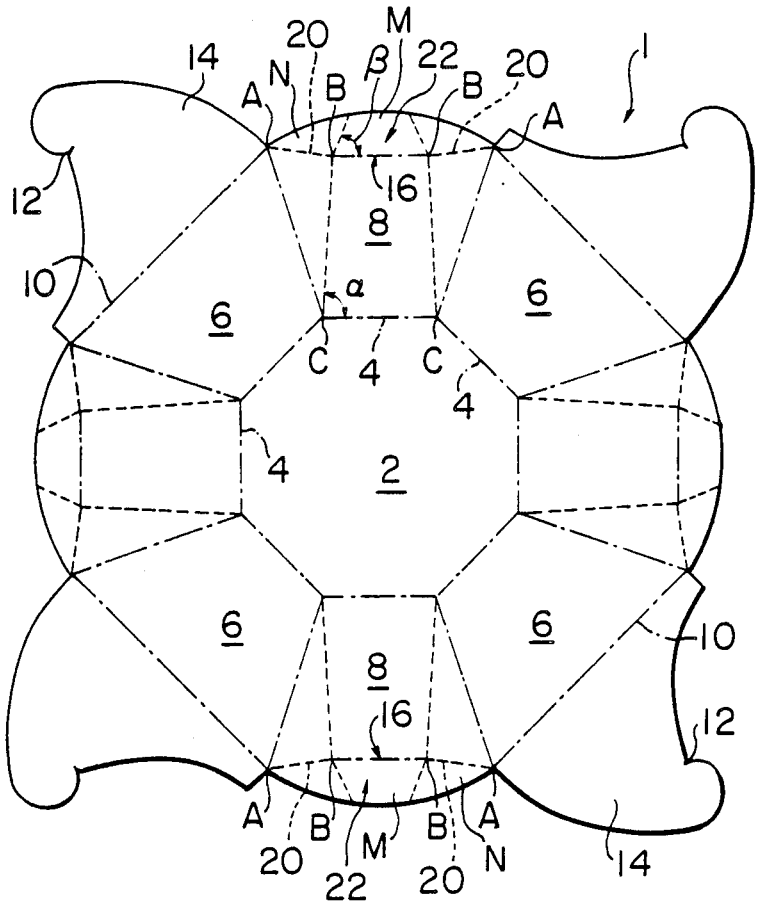
FIG. 1 shows a plan view of the base board of the present embodiment in accordance with the present invention.

A description of a preferred embodiment will be made in the following by taking reference to the accompanying drawings. Referring to FIG. 1, a bottom surface 2 is formed in the shape of a regular octagon in the center of the base board 1. Each side 4 of the bottom surface 2 is provided with a concave fold line. It is noted that, in FIG. 1 the dot-dash lines indicate concave fold lines and the dotted lines indicate convex fold lines. Each side 4 of the bottom surface 2 is alternately integrally provided with a first side plate 6 and a second side plate 8. The outer side 10 of the first side plate 6 is provided with a concave fold line and a lid plate 14 having a hook 12 at the end is integrally provided outside the outer side 10.

On the other hand, the outer side 16 of the second side plate 8 is constituted by two inclining lines AB 20 which are inclined inward with respect to the line between the vertexes A of the first side plate 6 on each end of the outer side 16 which is parallel with a side 4 of the bottom surface 2, and parallel side BB 18 which is located between the two inclining sides AB 20. A tab 22 is integrally provided outside the outer side 16. The inclining sides AB are provided with convex fold lines and the parallel side BB is provided with a concave fold line.

A line CB connecting the vertex C of the bottom surface and a middle point B is inclined by an angle $=86°$ with respect to the side 4 and is provided with a convex fold line. Further outside the middle point B, a mountain fold line is provided which is inclined by an angle $=65°$ with respect to the side BB which is parallel with the side 4. The two radially extending convex fold lines which are connected at the middle points BB may be made cutting lines so that even a hard base board can be easily folded, to thereby ensure superior retentivity of the shape.

Figure 2:
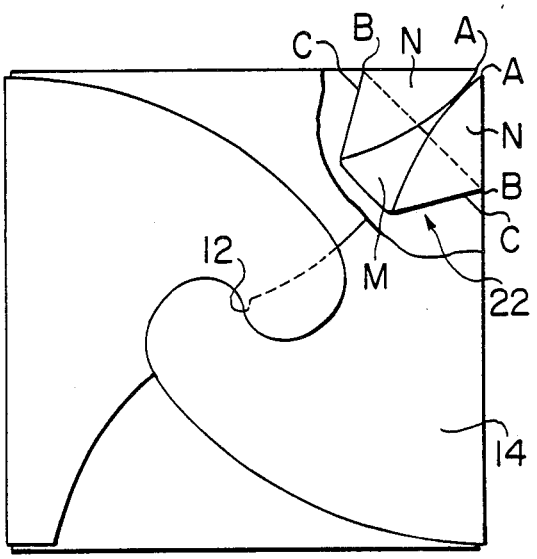
FIG. 2 is a top plan view of the erectable container of the present embodiment.
Figure 3:
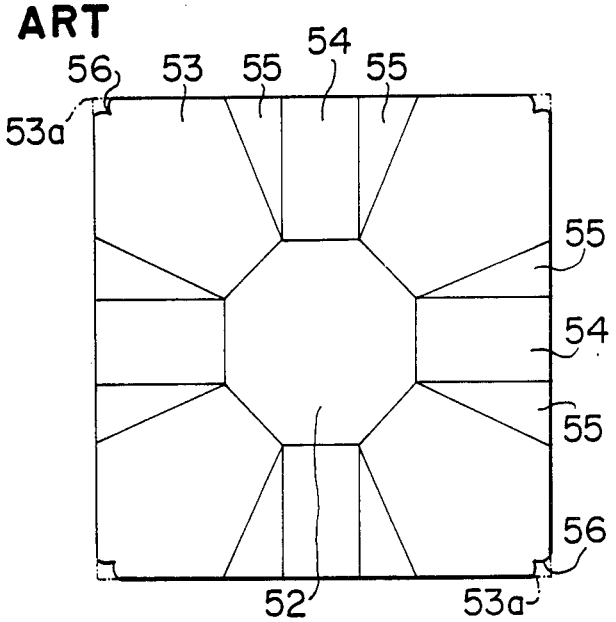
FIG. 3 PRIOR ART
FIG. 3 shows a plan view of the conventional erectable container.

Referring to FIG. 2, the base board described above is formed into the container by folding the respective fold lines to predetermined directions. In the upper portion of the second side plate 8 (shown in FIG. 1), the tab 22 is divided into three portions by convex folds. Of the three, the middle portion M is folded horizontally inwardly and each side portion N is folded over the middle portion M, to thereby allow the adjacent vertexes A of the first side plate 6 (shown in FIG. 1) to approach toward each other. These folds prevent the adjacent vertexes A from departing from each other with the result that the retentivity of shape is significantly reinforced. The hooks 12 on each opposite side plates 14 are made to be engaged with each other to thereby form a hooked lid.

To open the container half way for the purpose of stirring the contents or purposes similar to that, release the engagement of the hook portions and lift up the lid plate 14, if necessary. To fully open the container for the purpose of taking out the contents after heating or purposes similar to that, lift up the middle portion M of the tab 22 so that the portion M is on the same plane as the central portion of the second side plate 8, then spread out the respective side plates 6 and 8.

As described above, according to the present invention, a tab 22 is provided in the upper portion of the alternately provided second side plates which tab has the function of allowing the other adjacent side plates 6 to approach toward each other and retaining them in that state so that the erecting state of the side plates is easily maintained with the result that a superior retentivity of shape is obtainable. It is therefore possible to effectively and safely stir the contents in a liquid form or heat the same by microwave oven or the like.

Further, the tab 22 may be provided with cutting lines to make folding easier. Also, in this way, since the steam generated at the time of heating invades into the base board through the cutting lines to soften the neighboring area of the cutting lines, it becomes easier to fully open the container by erecting the tab.

The invention has thus been illustrated and described with reference to a specific embodiment, however, it should be noted that the invention is in no way limited to the details of the illustrated structures but changes and modifications may be made without departing from the scope of the appended claims.

We claim:

1. An erectable container formed by folding a single base board and comprising:

a bottom surface made in a polygonal form having more than six sides of an even number, first and second side plates alternately integrally extending from each side of the bottom surface via respective concave fold lines therebetween, a lid plate integrally provided on each said first side plate at an upper edge thereof opposite said concave fold line, each lid plate being hook-shaped at an upper edge thereof, and a tab integrally provided on each said second side plate at an upper edge thereof opposite the concave fold lines, each said second side plate being provided with two inclined first convex fold lines extending from respective lower vertexes thereof to separate points intermediate of the upper edge thereof, each said tab being provided with two second convex fold lines extending from respective ones of said intermediate points to an upper edge of said tab, the second convex fold lines approaching each other with an inclination greater than that of said first convex fold lines, and each said second side plate and tab being connected via a fold line that is concave at the portion between said intermediate points and is convex at the remaining portions.

2. An erectable container as defined in claim 1 wherein the base board has cuts along said first and second convex lines in the vicinity of each said intermediate point.

* * * * *